US006186088B1

(12) United States Patent
Garnier et al.

(10) Patent No.: US 6,186,088 B1
(45) Date of Patent: Feb. 13, 2001

(54) SUPPORT BASE FOR SUPPORTING ACCESSORIES ON THE FLEXIBLE WALL OF AN INFLATABLE BODY AND PNEUMATIC BOAT FITTED THEREWITH

(75) Inventors: Gérard Garnier, Rochefort-sur-Mer; Frédéric Lock, Saint-Nazaire-sur-Charente, both of (FR)

(73) Assignee: Zodiac International, Issy les Moulineaux (FR)

( * ) Notice: Under 35 U.S.C. 154(b), the term of this patent shall be extended for 0 days.

(21) Appl. No.: 09/105,726

(22) Filed: Jun. 26, 1998

(30) Foreign Application Priority Data

Jun. 30, 1997 (FR) ..... 97 08196

(51) Int. Cl.[7] ..... B63B 7/00; B63B 35/58
(52) U.S. Cl. ..... 114/345; 441/40
(58) Field of Search ..... 114/345, 357, 114/218; 441/40

(56) References Cited

U.S. PATENT DOCUMENTS

| | | | | |
|---|---|---|---|---|
| 3,168,751 | * | 2/1965 | Cavaignac et al. | 114/345 |
| 4,329,751 | * | 5/1982 | Cigognetti | 114/345 |
| 4,449,473 | | 5/1984 | McCrory et al. . | |
| 4,628,854 | * | 12/1986 | Harding | 114/345 |
| 4,938,162 | | 7/1990 | Hanlon . | |
| 4,966,091 | * | 10/1990 | De Suarez D Anlan | 114/345 |
| 4,976,213 | * | 12/1990 | Smith | 114/345 |
| 5,518,431 | * | 5/1996 | Staley | 441/130 |

FOREIGN PATENT DOCUMENTS

| | | |
|---|---|---|
| 0297920 | 1/1989 | (EP) . |
| 0321235 | 6/1989 | (EP) . |
| 576561 | 4/1946 | (GB) . |
| 2054474 | 2/1981 | (GB) . |

OTHER PUBLICATIONS

French Preliminary Search Report dated Mar. 24, 1998 (2 pages).

* cited by examiner

*Primary Examiner*—S. Joseph Morano
*Assistant Examiner*—Patrick Craig Muldoon
(74) *Attorney, Agent, or Firm*—Dean W. Russell; Kilpatrick Stockton LLP

(57) ABSTRACT

Support base for supporting accessories on the flexible wall of an inflatable body and an pneumatic boat fitted therewith.

A mounting base (10) intended for the fixing of an accessory onto the flexible wall of an inflatable body, such as an inflatable buoyancy fender of an inflatable boat, characterized in that it includes a stack (11) of several layers of flexible material fixed one to the other and passed through by at least one fitting (16) appropriate to the fixing of the aforesaid accessory, the aforesaid mounting base being fixable to the inflatable body flexible wall, the number of layers of the stack being determined so that the thickness of the stack corresponds approximately to the height of an anchoring part of the fitting.

16 Claims, 4 Drawing Sheets

SUPPORT BASE FOR SUPPORTING ACCESSORIES ON THE FLEXIBLE WALL OF AN INFLATABLE BODY AND PNEUMATIC BOAT FITTED THEREWITH

FIELD OF THE INVENTION

The present invention concerns improvements made to the fixing of accessories onto the flexible wall of an inflatable body, such as an inflatable buoyancy fender of an inflatable boat.

BACKGROUND OF THE INVENTION

The mounting of certain, rigid and most often metallic, accessories of an inflatable boat must be made in a mechanical way, for example by bolting, force fitting, screwing (whether the accessory is itself threaded and screwed onto a fitting or else fixed with the aid of bolts),etc.

Up to the present time, this method of mechanical fixing has only been realized by attaching to the inflatable body, in particular to the boat's inflatable fender, a rigid mounting base, especially constituted by plastic or composite material, which is structurally equipped to receive the aforesaid accessories. Of course, the aforesaid mounting base must itself be fixed to the inflatable body in a reliable way: the real cost of the mounting base and its complex fixing to the inflatable body make this solution expensive and not very satisfactory because the presence of one or several rigid mounting bases in practice prevents the deflation and folding of the boat. In addition, in order to avoid the proliferation of such mounting bases all along the inflatable buoyancy fenders, the accessories are grouped together on one single mounting base or on a very limited number of mounting bases, with the result that the accessories are not as numerous as is desirable and/or are not located in favourable locations.

As an example, in FIG. 1 is shown a mounting base of the previously mentioned type which is situated at the front end of an inflatable boat, where the two lateral buoyancy fenders 2 meet. The mounting base 1, of complex shape, rests on the fenders 2 and fits the external contour and is shaped on top as a plate 3 on which are fixed various accessories such as a fairlead 4, a cleat 5, a pennant holder pole 6, etc. In this example, the front edge of the plate of the mounting base is also indented in 7 and shaped as a rounded guide for the passage of a towing or mooring line.

In these conditions, this type of equipment is at the moment reserved for expensive inflatable boats, constituting the top end of the range, and there is currently a demand for a less expensive solution enabling the equipping of all types of boat, including boats of simple design, in a way such that the cost price is not excessive and that, in addition, the deflatable and foldable character of the inflatable boat is not destroyed.

The basic object of the invention is to propose a technically simple and financially cost-effective solution which enables the practical requirements to be met.

To these ends, the invention proposes a mounting base intended for the fixing of an accessory onto the flexible wall of an inflatable body, such as an inflatable boat inflatable buoyancy fender, which mounting base, being fitted in accordance with the invention, is characterized basically in that it includes a stack of several layers of flexible material fixed one to the other and passed through by at least one fitting appropriate for the fixing of the aforesaid accessory, the aforesaid mounting base being fixable to the flexible wall of the inflatable body, the number of layers of the stack being determined so that the thickness of the stack is approximately equal to the height of an anchoring part of the fitting.

Preferably, the lower layer of the stack has a dimension greater than that of the other layers, so as to be able to fit the shape of the flexible wall of the inflatable body to which it is fixed.

In a simple and cost-effective application, the layers forming the stack are bonded or thermally welded one to the other.

It is desirable that the stack of layers be provided with an outer backing sheet or film, so that the mounting base can be joined harmoniously to the inflatable body wall.

In practice, the fitting can be clamped in the stack, and more importantly this fitting, which may be in particular metallic, may be either tubular for receiving a complementary male part or may present a projecting rod for receiving a complementary female part; in both cases the fitting can be threaded to receive the complementary part by screwing.

In order to avoid the lower end of the fitting, which is rigid and aggressive, doing damage in the long term to the inflatable body flexible wall on which it may bear, it will be beneficial for the bottom layer, in the stack, to be solid and for the end of the fitting to be covered so as to provide protection between the fitting and the inflatable body wall.

As a result of layouts in accordance with the invention explained above, a mounting base is constituted which is cost-effective, as much from the point of view of the constituent material as that of the manufacturing process, which concerns a relative flexibility enabling it to easily fit, in view also if necessary of its relatively restricted dimension, the curvilinear contour of the wall onto which it is fixed, which once in place on the aforesaid wall forms only the strictly necessary projection in relation to the height of the fitting, particularly the anchoring height of the fitting, and which, in these conditions, can be arranged in any number in any location of the inflatable body without hindering unduly the operation of deflation and folding of the latter.

All the layouts in accordance with the invention can find a particularly interesting application for fixing the transom of an inflatable boat. An inflatable boat, comprising two lateral inflatable buoyancy fenders braced by a rigid bottom, at least transversely, is closed at the rear by a rigid transom which extends between the two fenders and which is fixed to them, at the same time that it is, underneath, fixed in a sealed way to the bottom. Currently, each curvilinear lateral edge of the transom is connected to the respective fender by a curvilinear U section of synthetic material which is bonded and/or welded to the fender: this technique is complex and expensive.

The implementation of a fixing technique by bolting, screwing or riveting would in particular enable this fixing to be simplified and the cost price to be lowered. The implementation of a fixing mounting base fitted in accordance with the invention enables access to one such simplified and less expensive fixing technique.

In accordance with the invention, the transom is fixed to each fender by means of at least one angle iron which is bolted and/or screwed and/or riveted on to at least one fixing component fixed to the aforesaid fender with the aid of a mounting base fitted as previously mentioned.

Although recourse may be considered to an angle iron extending over the entire curvilinear height of the lateral side of the transom, in the same way as the U section used up until the present, it is however more advantageous to have recourse to much smaller fixing pieces and to plan that each transom angle iron fixing onto the respective fender is constituted by two angle brackets located respectively at the top and at the bottom of the transom. By preference then, each angle bracket is bolted onto at least one approximately radial threaded rod supported on the fender with the aid of a mounting base.

For the connection of the transom to the angle brackets, it is possible to plan for the angle brackets to be projecting lugs forming an integral part of the transom; or again for the transom to be fixed to each angle bracket by screwing and/or bolting and/or riveting.

BRIEF DESCRIPTION OF THE DRAWINGS

The invention will be better understood by reading the detailed description which follows of certain ways of application which are given only as non-restrictive examples. In this description, the appended drawings are referred to on which.

DETAILED DESCRIPTION

Figure 1:
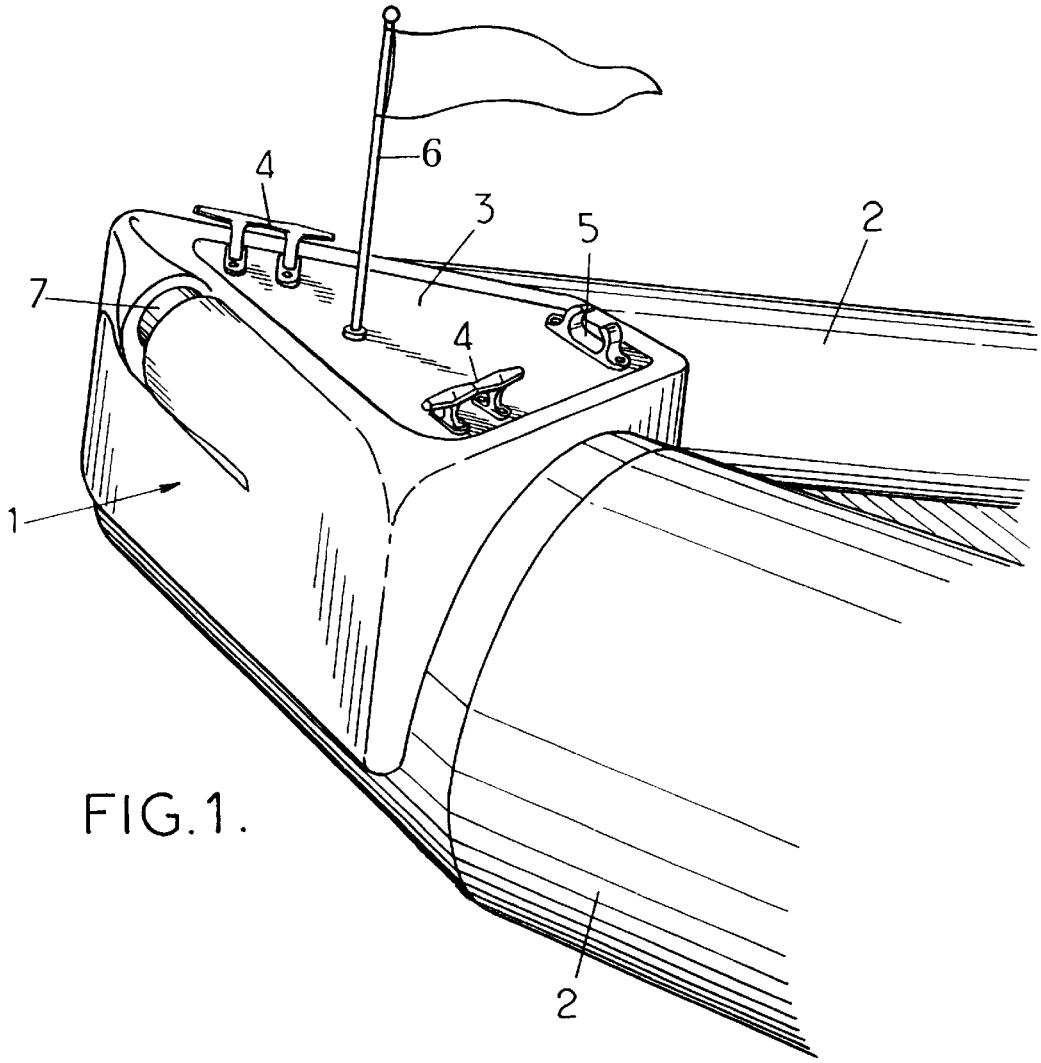
Figure 2:
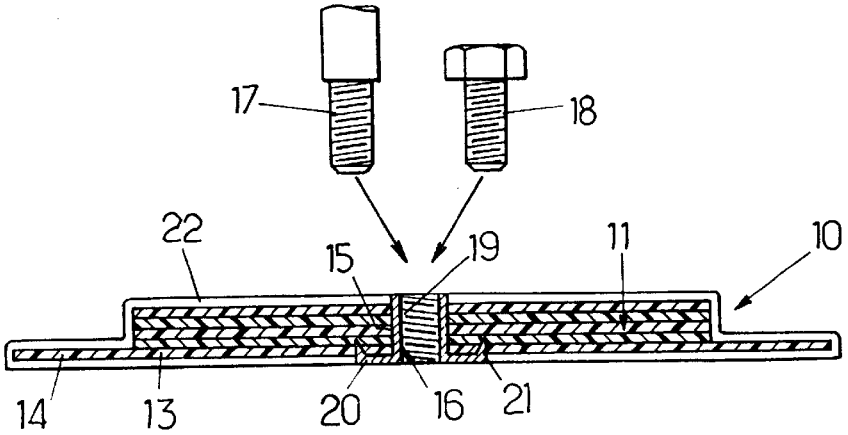
FIGS. 2 to 6 are section views respectively illustrating various possible application examples of the mounting base according to the invention.

Referring first to FIG. 2, the mounting base, designated in its entirety by the reference number 10, is constituted by a stack 11 of several layers 12 of flexible material such as that used for the manufacture of the inflatable parts (lateral fenders, keel, etc.) of an inflatable boat. These layers are fixed one to the other, for example welded (thermo-welding) and/or bonded so that the stack has a relative rigidity, not excluding however a capability for a small deformation, for example with a slight curvature enabling it to fit the carved contour of an inflatable fender of an inflatable boat.

In order to facilitate the fixing of the mounting base 10 onto its support, particularly when the latter is curved (for example an inflatable fender), the lower layer, designated more specifically by the reference 13, can advantageously present an area greater than that of the underlying layers 12, so that, by its projecting peripheral edge 14 which retains its flexibility, it can better fit the curvature of the support and be more effectively fixed to it.

In the example shown in FIG. 2, the mounting base 10, has been assumed to have a circular contour, and therefore to have an overall disc shaped appearance.

At the centre of the mounting base is made an aperture 15 into which is introduced a fitting or a fitting part 16 appropriate for the fixing of an accessory. This fitting is rigid and may particularly be metallic. In FIG. 2, is shown the fitting 16 in the form of a tubular component 19 internally threaded to receive by screwing either the threaded end 17 of the accessory itself, or an accessory fixing screw or bolt 18. The fitting 16 is fixed in the stack 11 by any appropriate means and it can be conformed in any appropriate manner to this effect. It can in particular be constituted by two assemblable pieces, brought from either side the stack 11; it can be bonded in the aperture 15 and/or on the upper and lower surfaces of the stack 11. In FIG. 2, it has been assumed that the fitting 15 was of the clampable type and that at one end of the threaded tubular component 19 was joined a plate or head 20 provided with a certain number of claws 21 directed parallel to the tubular component 19.

The number of layers 12, 13 constituting the stack 11 is fixed to correspond with the height of the fitting.

Figure 3:
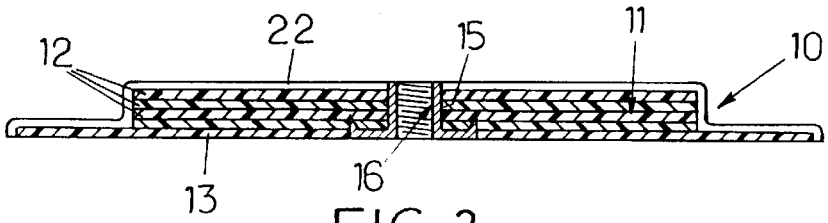
Figure 4:
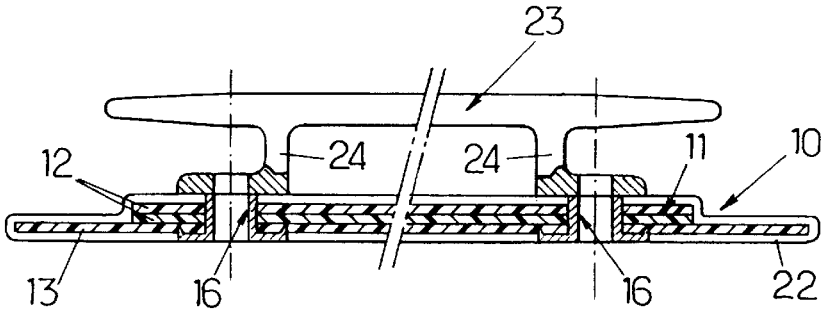
Figure 6:
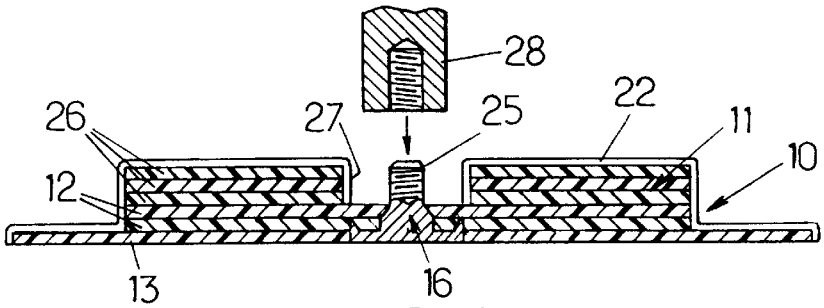

Finally, provision is made for the stack 11 of layers 12, 13 to be surrounded by a backing sheet or film 22 the object of which is both to conceal the not very attractive stacked layers and to ensure colour coordination with the inflatable body on which the mounting base is fixed. This covering 22 can be total, that is to say totally surround the stack 11, including its under face, as shown in FIG. 2; or else it can be partial and only cover the visible faces of the stack 11, with the exclusion of the top face as illustrated in FIGS. 3, 4, and 6. The cover 22 is bonded and/or welded onto the stack 11 and, when it covers the lower face, it is this which serves as the fixing onto the inflatable body.

When, as illustrated in FIG. 2, the aperture 15 outlet is in the mounting base lower face and the fitting 16 is constituted by a hard material (metal) with its lower edge approximately flush with the lower edge of the aperture 15, there is a risk that the fitting will bear on the underlying wall of the inflatable body and abrade this wall, thereby causing a leak. To avoid this disadvantage, it is desirable to design the stack in a way which avoids contact of the lower end of the fitting with the inflatable body wall: to that end, the stack can be given a thickness slightly greater than the height of the fitting, so that the fitting lower end is slightly withdrawn relative to the lower face of the mounting base as illustrated in FIG. 2, or else to provide a sheet insert under the fitting, for example design the lower layer 13 in a solid form (that is to say without perforation, the aperture 15 not having an outlet underneath) as illustrated in FIG. 3.

It is understood that, because of its structure, the mounting base complying with the invention can lend itself to all geometric adaptations required (thickness, shape) in order to be shaped to correspond with the object to be fixed. For example, for the fixing of an elongated object such as a fairlead 23 provided with two fixing feet as illustrated in FIG. 4, the mounting base 10 can take an elongated shape adjusted to the spacing of the fairlead feet 24 and be provided with two fittings 16 corresponding with the aforesaid feet 24. In this example, it has been assumed that the fittings were small in height only requiring a mounting base of relatively small thickness and constituted by only three layers 12, 13.

Figure 5:
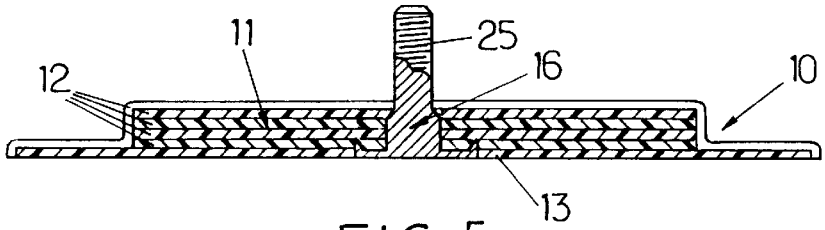

In order to clarify matters, a mounting base is shown in FIG. 5 equipped with a different type of fitting 16, comprising a projecting threaded rod 25, the head of which (whatever the shape and the design) is buried in the layers 12. If it is desired to install two or more projecting threaded rods located side by side and parallel to each other, two or more screws or bolts may be used screwed into a rigid, for example metallic, plate, which is buried in the constituent layers 12 of the stack 11 (not shown).

If a protection is desired for the projecting threaded rod 25 which can prove to be aggressive, the layers in the stack 11, in number and in shape, can be arranged in a way that they surround the threaded rod 25 and that the latter is encased as illustrated in FIG. 6. In this case, the layers 12 of the stacks 11 illustrated previously are surmounted by several layers 26 of the same dimensions and external shape as the layers 12, but channelled out in the centre in 27 so as to constitute, around the rod 25, a clearance allowing the passage of a female component 28 which can be screwed on the rod 25.

The layouts in accordance with the invention can find a particularly interesting application in the fixing of the transom of an inflatable boat onto each lateral inflatable buoyancy fender which equip it.

Figure 7:
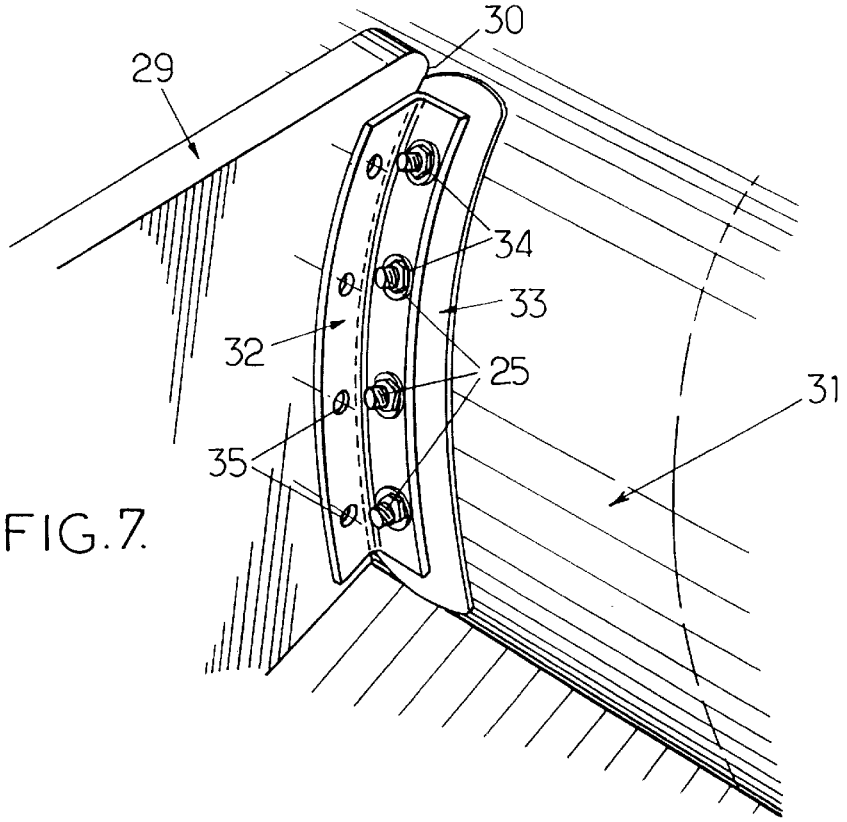
FIGS. 7 and 8 are partial perspective views illustrating two examples of fixing an inflatable boat transom onto an inflatable buoyancy fender, implementing the layouts of the invention.

By referring first to FIG. 7, a transom 29, which appears generally in the form of a rigid wooden panel, is connected by its curvilinear lateral edge 30 to the side of a lateral inflatable buoyancy fender 31 equipping an inflatable boat.

The fixing is effected by means of a longitudinally curvilinear angle iron 32, preferably with a transverse L section. If necessary, two L shaped angle irons placed back to back can be applied respectively against the two faces of the transom 29, or else recourse can also be made to a p shaped angle iron with projecting flanges.

In any case, the angle iron 32 is fixed by bolting and/or screwing and/or riveting onto the fender 31 by means of one or more mounting bases 33 arranged as indicated above. In FIG. 7, the mounting base 33 has been assumed to be single, elongated and equipped with several radially projecting threaded rods 25 in accordance with a layout modelled on that of FIG. 5 previously mentioned; the angle iron 33 is bolted onto these threaded rods by means of nuts 34.

As for the transom 29, it too is fixed to the angle iron 32 by bolting and/or screwing and/or riveting (only the corresponding holes 35 made for this purpose in the angle iron 32 have been shown).

However, it will be understood that such a fixing method, which is very resistant mechanically, does not fundamentally require recourse to a connecting piece which extends continuously over the whole height of the transom 29, as illustrated in FIG. 7.

Figure 8:
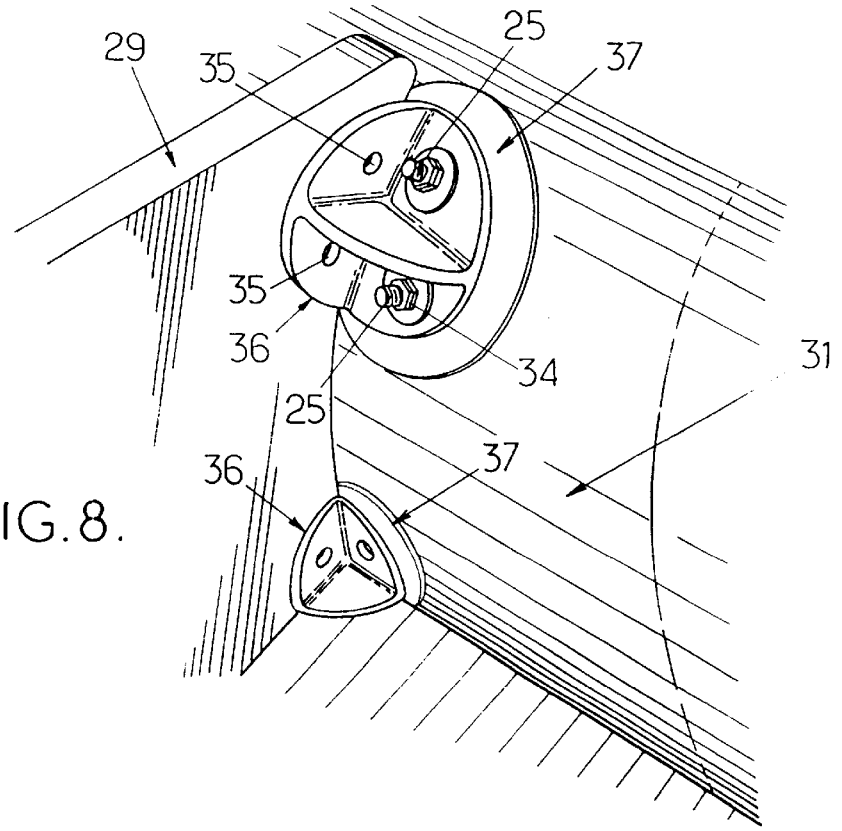

As illustrated in FIG. 8, the angle iron may then be constituted in a discontinuous way by two angle brackets 36 located at the top and bottom of the transom 29 and assembled by bolting (as illustrated) and/or screwing and/or riveting onto two respective mounting bases 37 designed on the example of that in FIG. 5.

Figure 9:
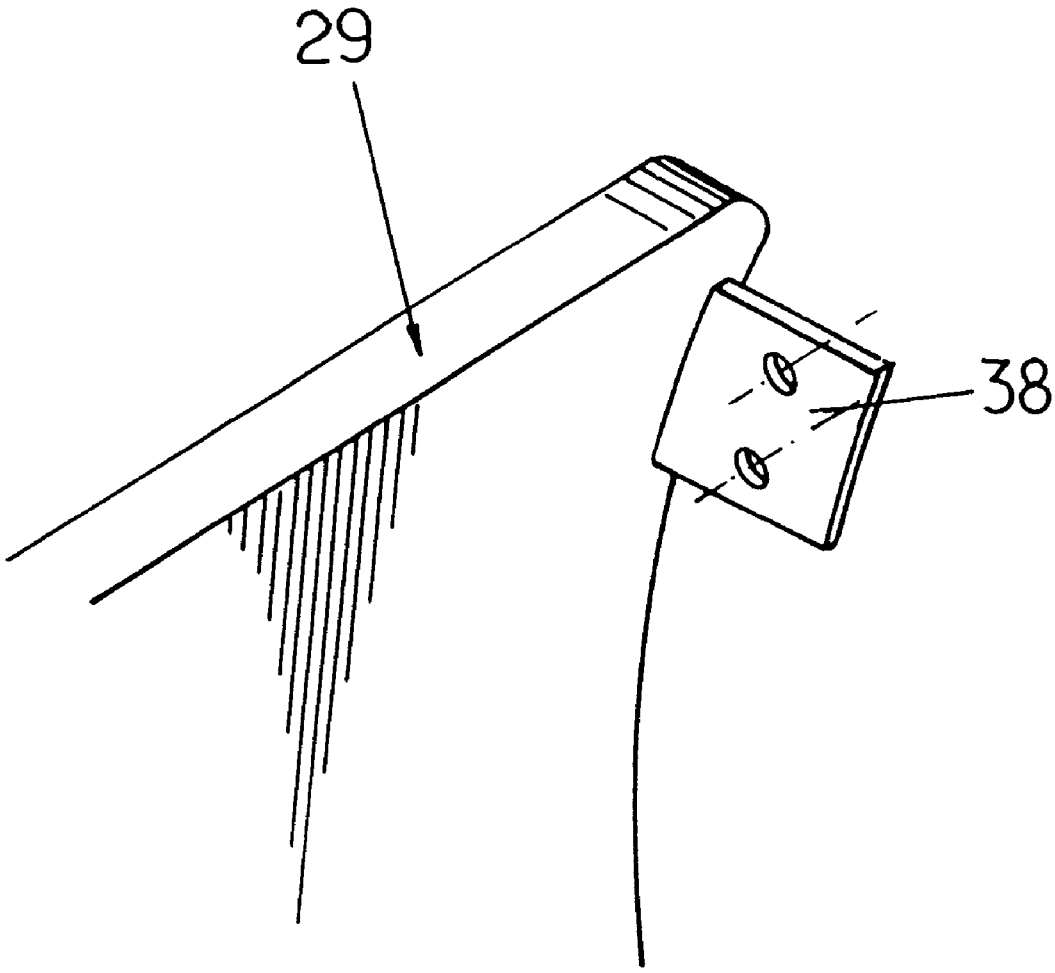
FIG. 9 is a realisation variant of the preferred example of FIG. 8.

As a variant of the layout of FIG. 8, the angle brackets may, as illustrated in FIG. 9, be constituted in the form of projecting lugs 38 as an integral part of the transom 29.

As a result of implementing the mounting base fixing in accordance with the invention, a simplified connection is made between the transom and the buoyancy fenders which is mechanically very resistant and which particularly is capable of transmitting the stresses imparted by an outboard propulsion engine fixed to the transom.

As is apparent and as a consequence of what has been previously stated, the invention is in no way restricted to those methods of application and implementation which have been more particularly considered; it encompasses on the contrary all the variants.

What is claimed is:

1. A mounting base intended for the fixing of an accessory onto the flexible wall of an inflatable body, the flexible wall having an exterior surface, the mounting base comprising a stack of several layers of flexible materials fixed one to the other and passed through by an anchoring part of at least one fitting appropriate to the fixing of the aforesaid accessory, the aforesaid mounting base being fixable to the exterior surface of the inflatable body flexible wall, the number of layers of the stack being determined so that the thickness of the stack corresponds at least to approximately the height of the anchoring part of the fitting.

2. A mounting base in accordance with claim 1, in which the lower layer of the stack has a dimension greater than that of the other layers, so as to be able to fit the shape of the inflatable body flexible wall to which it is fixed.

3. A mounting base in accordance with claim 1 in which the layers forming the stack are bonded, thermally welded, or both one to the other.

4. A mounting base in accordance with claim 1 further comprising an outer backing sheet or film.

5. A mounting base in accordance with claim 1 in which the fitting is clamped into the stack.

6. A mounting base in accordance with claim 1 in which the fitting is tubular in order to receive a complementary male part.

7. A mounting base in accordance with claim 6 in which the fitting is threaded for receiving the complementary part by screwing.

8. A mounting base in accordance with claim 1 in which the fitting presents a projecting rod to receive a complementary female part.

9. A mounting base in accordance with claim 1 in which the fitting is metallic.

10. A mounting base in accordance with claim 1 in which the bottom layer of the stack is solid and covers the end of the fitting.

11. An inflatable boat having two lateral inflatable fenders, at least one defining a flexible wall having an exterior surface, the boat comprising at least one mounting base which includes a stack of several layers of flexible materials fixed one to the other and passed through by an anchoring part of at least one fitting, the mounting base being fixable to the exterior surface of the flexible wall of the boat, the number of layers of the stack being determined so that the thickness of the stack corresponds at least to approximately the height of the anchoring part of the fitting.

12. An inflatable boat in accordance with claim 11 in which a transom extends between the two fenders and a bottom to which is it connected in a sealed way and in which the transom is fixed to each fender by at least one angle iron which is bolted, screwed, or riveted onto at least one fixing component fixed to at least one of the fenders by means of at least the mounting base.

13. An inflatable boat in accordance with claim 12 in which each angle iron fixing the transom onto the respective fender is constituted by two angle brackets located respectively at the top and bottom of the transom.

14. An inflatable boat in accordance with claim 12 in which each angle iron fixing the transom onto the respective fender is constituted by two angle brackets located respectively at the top and bottom of the transom and in which each angle bracket is bolted onto at least one approximately radial threaded rod supported on the fender by means of a mounting base.

15. An inflatable boat in accordance with claim 12 in which each angle iron fixing the transom onto the respective fender is constituted by two angle brackets located respectively at the top and bottom of the transom and in which the angle brackets have projecting lugs integral with the transom.

16. An inflatable boat in accordance with claim 12 in which each angle iron fixing the transom onto the respective fender is constituted by two angle brackets located respectively at the top and bottom of the transom and in which the transom is fixed to each angle bracket by one or more actions selected from the group of screwing, bolting, and riveting.

* * * * *